US007686272B2

(12) United States Patent
King

(10) Patent No.: US 7,686,272 B2
(45) Date of Patent: Mar. 30, 2010

(54) ADJUSTABLE DISPLAY HOLDER

(75) Inventor: Randall King, Eugene, OR (US)

(73) Assignee: TipBar Incorporated, Eugene, OR (US)

( * ) Notice: Subject to any disclaimer, the term of this patent is extended or adjusted under 35 U.S.C. 154(b) by 84 days.

(21) Appl. No.: 11/820,864

(22) Filed: Jun. 20, 2007

(65) Prior Publication Data

US 2008/0315053 A1 Dec. 25, 2008

(51) Int. Cl.
*A47B 97/04* (2006.01)

(52) U.S. Cl. ..... 248/448; 248/454; 248/458; 248/473

(58) Field of Classification Search ..... 248/463, 248/472, 473, 456, 479
See application file for complete search history.

(56) References Cited

U.S. PATENT DOCUMENTS

| | | | | |
|---|---|---|---|---|
| 3,999,734 | A * | 12/1976 | Gibson et al. | 248/460 |
| 4,957,263 | A * | 9/1990 | Leluan, Jr. | 248/473 |
| 5,915,661 | A * | 6/1999 | Silverman et al. | 248/465.1 |
| 6,352,233 | B1 * | 3/2002 | Barberich | 248/676 |
| 6,918,565 | B2 * | 7/2005 | Chang | 248/448 |
| 2004/0065629 | A1 * | 4/2004 | Hunt et al. | 211/40 |

* cited by examiner

*Primary Examiner*—J. Allen Shriver, II
*Assistant Examiner*—Alaeddin Mohseni
(74) *Attorney, Agent, or Firm*—Alleman Hall McCoy Russell & Tuttle LLP

(57) ABSTRACT

An adjustable display holder is disclosed. One embodiment provides a display arm and a display base, wherein the display arm is pivotably connected to the base, and the arm and base have a tongue and groove arrangement, wherein the arm may be elastically deformed to connect to the base, and the arm may retain a shape that arranges the tongue and groove in a way that resists relative pivoting between the arm and base. In this manner, an adjustable display holder may be easily configured without compromising the utility of the display holder.

17 Claims, 4 Drawing Sheets

ADJUSTABLE DISPLAY HOLDER

BACKGROUND

This invention relates to the general field of display apparatus, and more particularly to a robust and easy to use adjustable holder for displaying plates, photographs, plaques, and the like.

Existing display holders consist of a plastic base and a wire arm that is machine riveted to the plastic base in two pivot points. The rivets in the wire arm are sufficiently tight to hold the wire arm in a certain orientation with respect to the plastic base, yet sufficiently loose to allow movement of the wire arm respective to the base. The wire arm may be opened to a display position by grasping the wire arm and the plastic base, and pulling them apart to a desired display angle.

Unfortunately, the machine riveted pivot points often differ in rotational friction, resulting in bending of the plastic base and thus an uneven display base. Further, the machine riveted pivot points may be rotated too far or have non-linear rotational friction, resulting in an unstable display holder that may tilt and spill the effects it is holding. Further, adjustment of the already tightened machine rivets results in wear on the display holder and may result in breakage of the plastic base, etc. Additionally, display holders consisting of a plastic base and a wire arm require more labor to assemble, and thus more cost to deliver to market.

SUMMARY

Accordingly, an improved display holder is described below in the Detailed Description. For example, one embodiment provides a display holder comprising a display arm and a display base, wherein the display arm is pivotably connected to the base, and the arm and base have a tongue and groove arrangement, wherein the arm may be elastically deformed to connect to the base, and the arm may retain a shape that arranges the tongue and groove in a way that resists relative pivoting between the arm and base. In this manner, an adjustable display holder may be easily configured without compromising the utility of the display holder.

In another embodiment, an adjustable display holder may include a display arm substantially in a U-shape, the display arm having pivot posts on an open end of the U-shape and further having at least one protruding tongue arranged substantially in the direction of the pivot posts, and a base with pivot post holes to receive and pivotably connect to the pivot posts of the display arm, the base further having at least one groove to receive the protruding tongue of the display arm, wherein the U-shape of the display arm may be elastically deformed by a force to insert the pivot posts into the pivot post holes and the display arm may spring the protruding tongue into the at least one groove at the release of the force and hold the display arm in relative position to the base by the protruding tongue and groove arrangement.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
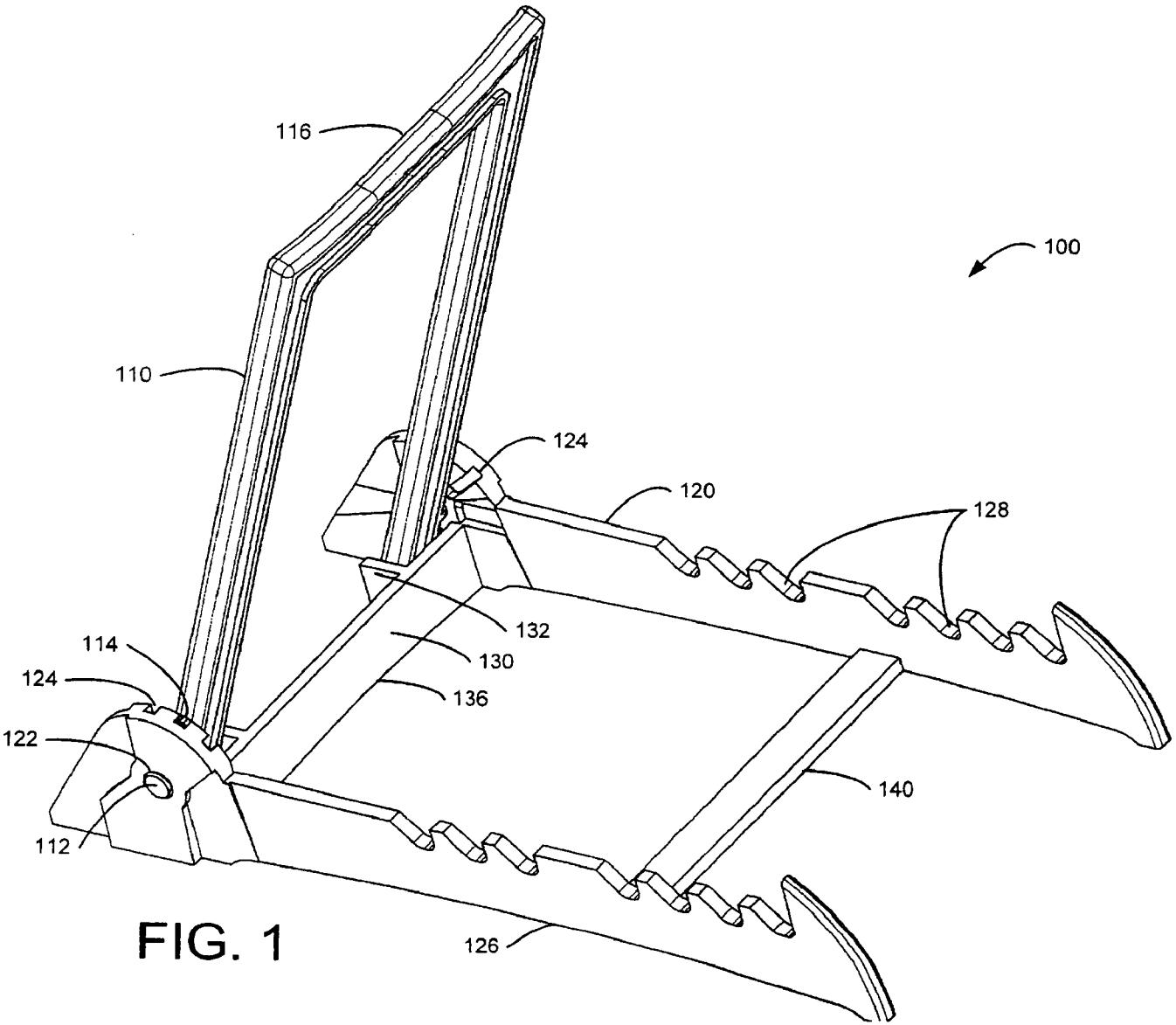
FIG. 1 is a perspective view of one embodiment of an adjustable display holder.

FIG. 1 illustrates one embodiment of an adjustable display holder 100 including a base 120 and a flexible display arm 110. In one embodiment, the display arm 110 may be substantially in a U-shape. A substantially U-shaped display arm 110 provides for ease of manufacture as well as allowing the display arm 110 to bias elastically to a certain shape. In this manner, when the open ended portion of the U-shaped display arm is flexed either inward or outward, the display arm 110 will resist this flexion and function as a spring back towards its unflexed shape. Other embodiments are not limited to the U-shape display arm, and may be any other suitable geometry that allows elastic deformation where the display arm is biased towards its initial shape. In some embodiments, the base 120 is constructed from a single piece of material, for example the base may be molded using a single piece of plastic or other moldable material.

In some embodiments, the display arm 110 includes pivot posts 112 on an open end of the U-shape to pivotably engage the base 120. In this embodiment, the base 120 is constructed with pivot post holes 122 to receive and pivotably connect to the pivot posts 112 of the display arm 110. The elastic deformation of the display arm 110 allows it to be flexed to be inserted into the base 120, and the shape bias of the display arm then holds the pivot posts 112 in the pivot post holes 122 to fixably connect the adjustable display holder 100 together. In this way, the display arm 110 holds itself in place without applying uneven pressure on both sides of base 120, thus countering a distorted and unstable holder.

The display arm 110 further comprises at least one protruding tongue 114 arranged substantially in the direction of each pivot post 112. The base 120 of display holder 100 includes at least one groove 124 to receive each protruding tongue 114 of the display arm 110. In this manner, when the protruding tongues 114 are aligned with each groove 124, the shape bias of the display arm springs the tongues 114 into the grooves 124 and fixes the relative position of the display arm 110 to the base 120. Additionally, an adjustable display holder 100 can be assembled easily by flexing the display arm 110, and further be adjusted to different fixed display positions by aligning the protruding tongues 114 of the display arm with corresponding grooves 124 in the base, wherein the shape bias of the display arm 110 holds the tongues 114 in the grooves 124. In FIG. 1, the display holder 100 is oriented with tongues 114 inserted into middle grooves 124 of the base, illustrating one fixed display position.

In some embodiments, the display arm 110 may have multiple protruding tongues 114 arranged substantially in the direction of each pivot post 112. The base 120 may have multiple grooves 124 for each protruding tongue 114, thereby allowing multiple display positions to be created in the manner described above.

An alternate embodiment may have the pivot posts 112 and protruding tongues 114 facing inward wherein the display arm 110 is flexed outward to fixably connect the display arm 110 to the base 120. In yet another embodiment, the tongue and groove arrangement may alternatively be any suitable concave and convex tabs and slots to engage when aligned in the absence of an external force applied to either the display arm 110 or the base 120. Further, a base 120 may receive various sized display arms to support different display items. It would be understood by those of skill in the art that various alternate approaches may be used within the principles of this disclosure.

In one example embodiment, the base 120 of display holder 100 may comprise two side rails connected by a front cross member 140 and a rear cross member 130. The side rails may include notches 128 to collect a displayed item such as a plate (not shown), wherein the displayed item rests in corresponding notches 128 and tilts onto the display arm 110 at support member 116. The notches 128 may further be arranged with different geometries to provide support for different types of display items. In some embodiments, support member 116 may be curved to more securely hold the display item on display holder 100. In some embodiments, the base 120 may extend sufficiently beyond the pivot posts 112 to improve display holder 100 stability and supporting the display holder 100 to resist tipping over backwards.

In some embodiments, back cross member 130 may comprise a concave bottom surface 136 in a manner that allows only the side rails of base 120 to contact a surface the display holder 100 rests on. Furthermore, the side rails may have a concave lower surface 126 such that the base 120 rests on a surface on each of its corners, further improving the stability of the display holder 100. In some embodiments, back cross member 130 may have stops 132 to obstruct the display arm 110 from coming disconnected from the base 120 while the display arm is raised to a fixed display position. The stops may further be arranged flush with the top of cross member 130. In this manner, when the display arm 110 is resting on cross member 130 in a substantially planar arrangement with the base 120, the display arm 110 may be flexed to allow insertion of the pivot posts 112 into the pivot post holes 122 without being obstructed by the stops 132. In an embodiment, the display arm 110 can be attached only when the arm is in resting position. In some embodiments, the grooves 124 may be designed to not meet the pivot post holes 122 where the arm is attached in order to increase display arm 110 stability and the strength of the display holder 100.

In some embodiments, the back cross member 130 may be situated to provide support for the display arm 110 when the display arm is in its most open display position, for example if the display holder 100 had a maximum orientation of 90 degrees between the display arm 110 and the base 120. Embodiments may have orientations beyond 90 degrees, however, if the display arm 110 is opened much wider than this, a tall or heavy display item may shift the center of gravity of the display holder 100 and corresponding display item to back side of pivot posts 112. While this orientation can be tolerated to some degree, it can increase the risk of the display holder 100 tipping over, the display item with it.

In the present embodiment, cross member 140 may be situated above the plane intersecting the four corners of the base 120 to further improve stability of the display holder 100. In yet another embodiment, cross member 140 may be situated to not interfere with the notches 128 such that an item in the display will not be obstructed by the cross member 140. In some embodiments, the base 120 may be constructed with tall side rails to prevent displayed items from coming in contact with the surface the display holder 100 rests on.

Figure 2:
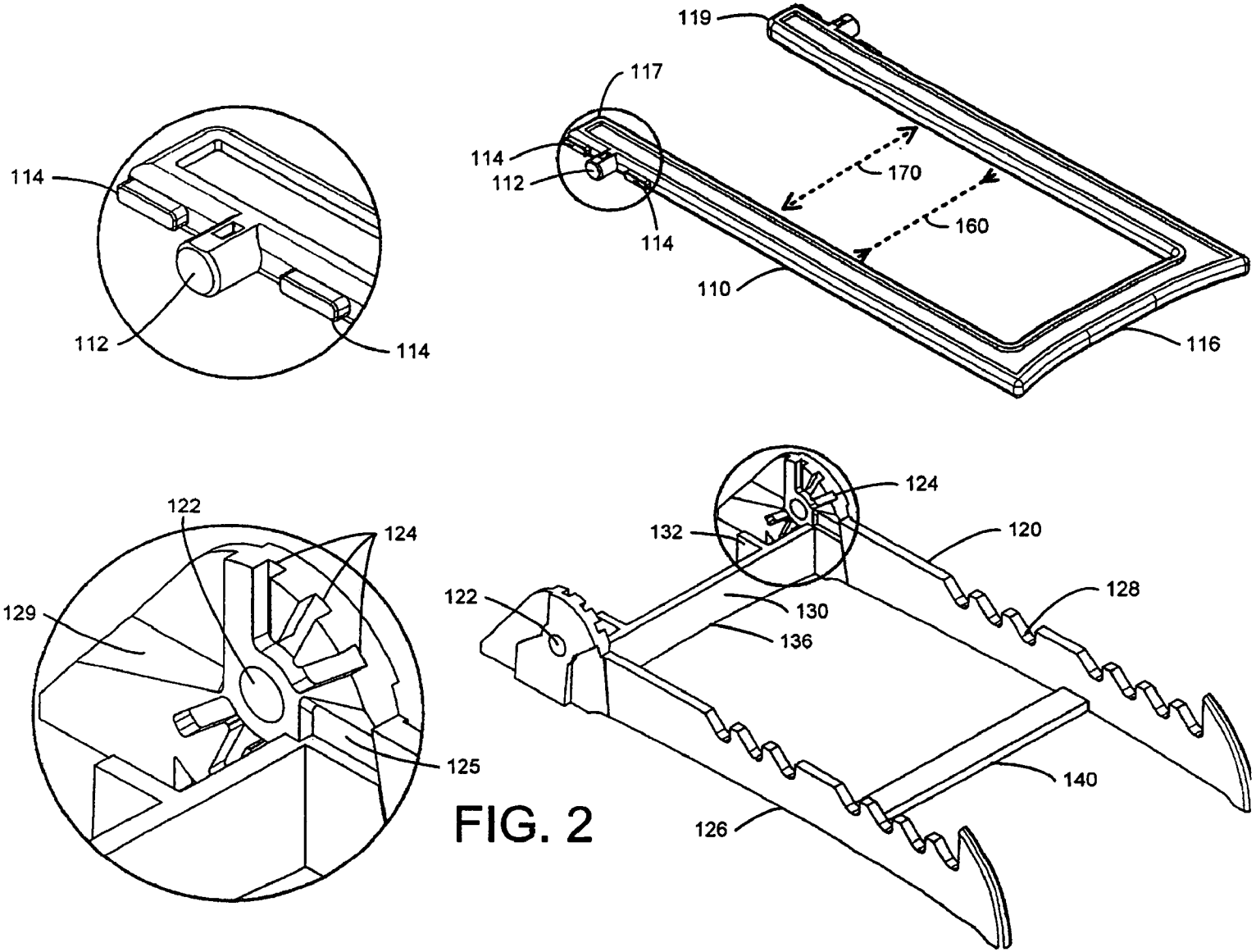
FIG. 2 is an exploded perspective view of one embodiment of an adjustable display holder, and in particular of a display arm and a base of an adjustable display holder.

FIG. 2 is an exploded perspective view of one embodiment of an adjustable display holder 100, and in particular of a display arm 110 and a base 120 of adjustable display holder 100. On the top of FIG. 2, an example display arm 110 includes pivot posts 112, protruding tongues 114, end portion 117, end portion 119, and support member 116. Axially opposed forces 170 and 160 represent an applied force to display arm 110 and the shape bias that opposes the applied force. In the present embodiment, a squeezing force 160 may be imparted on either side portion of display arm 110, for example by squeezing end portion 119 towards end portion 117. In this regard, pivot post 112 may be aligned with pivot post holes 122 in base 120, and by releasing the squeezing force 160, the elastic deformation of display arm 110 is reversed by a biasing force 170. In some embodiments, end portion 117 and end portion 119 may be pronated to provide a stronger or a more durable shape bias.

In an embodiment where the pivot posts 112 and protruding tongues are situated on the inside of display arm 110, the squeezing force 160 would be a separating force 170 and the bias force 160 of display arm 110 would oppose this force in similar manner. In alternate embodiments, tongues 114, pivot posts 112, pivot post holes 122 and grooves 124 may be arranged in any combination that allows various display positions to be fixedly oriented by lack of an external force deforming either the display arm 110 or base 120.

The embodiment display holder in FIG. 2 also illustrates a ramp portion 129 and a resting position 125. There may be a corresponding resting position on ramp portion 129 and a corresponding ramp portion for resting position 125. These ramp portions and resting positions allow the display arm to relax in a non-display position and not be under a sustained deformation. The relaxed position increasing the shape bias life of display arm 110 and thus the functional life of the present embodiment display holder.

Figure 3A:
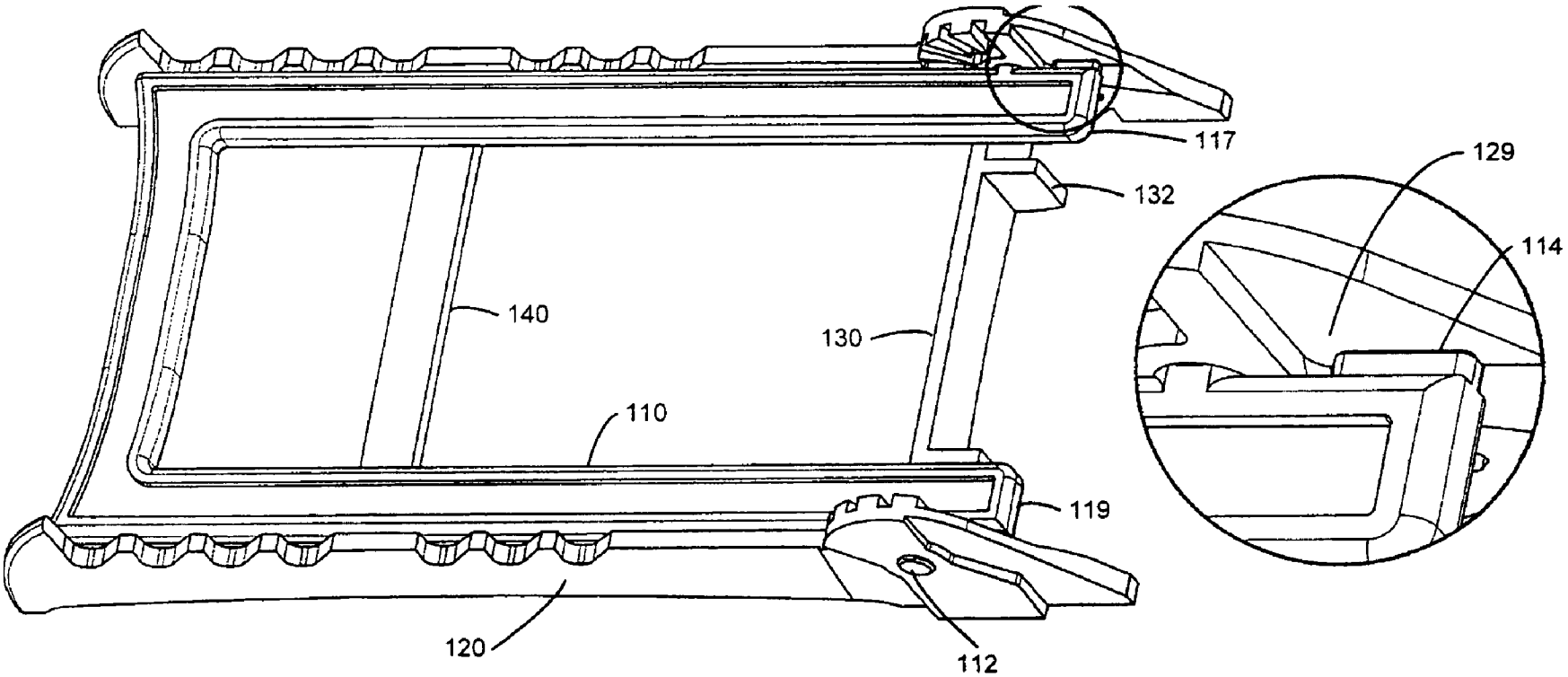
FIG. 3*a* is a back elevated perspective view of one embodiment of an adjustable display holder in a relaxed closed position.
Figure 3B:
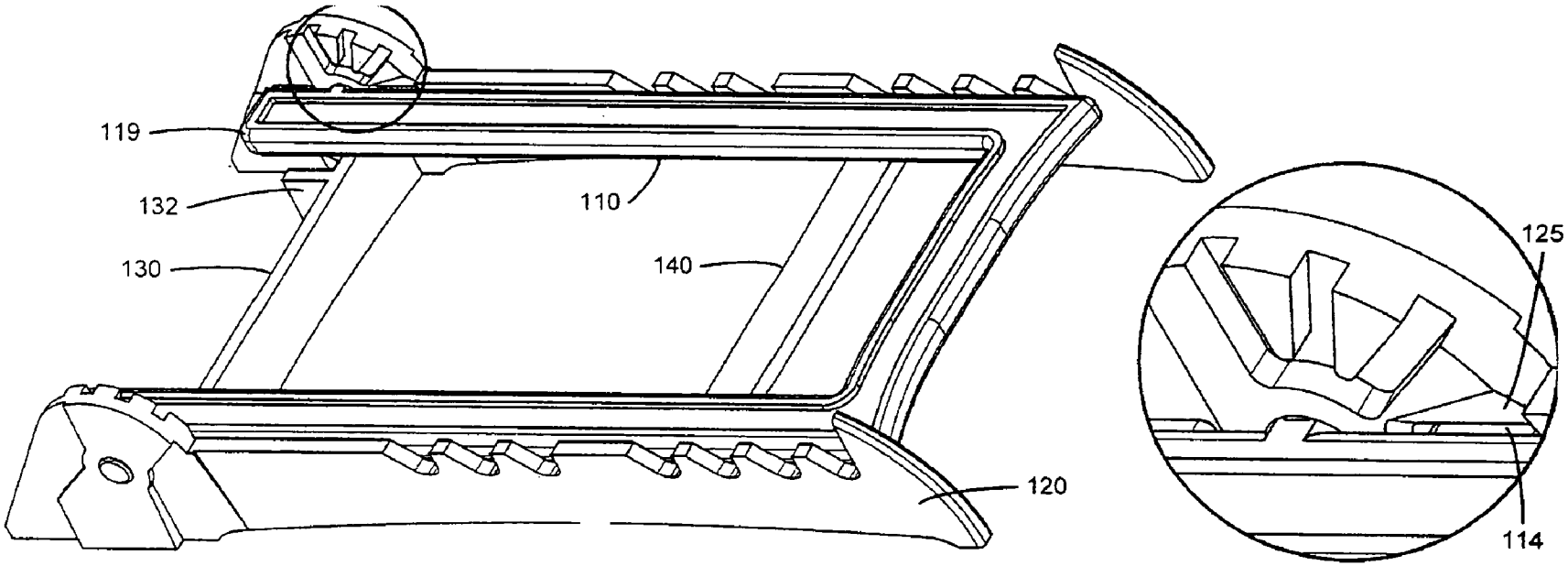
FIG. 3*b* is a front elevated perspective view of one embodiment of an adjustable display holder in a relaxed closed position.

FIG. 3*a* and FIG. 3*b* are a back elevated perspective view and a front elevated perspective view of one embodiment of an adjustable display holder in a relaxed closed position. FIG. 3*a* and FIG. 3*b* each illustrate the display arm in the relaxed position referred to in FIG. 2. In these figures the protruding tongues can be seen within resting position 125. In the present embodiment, when the display arm 110 is adjusted to a display position, ramp portion 129 applies the squeezing force to end portion 117 and end portion 119 such that by only pivotably rotating the display arm 110 relative to base 120, the display arm 110 undergoes elastic deformation and will snap and lock into the first groove portion that will receive protruding tongue 114 when they are aligned.

It will further be understood that the configurations and/or approaches described herein are exemplary in nature, and that these specific embodiments or examples are not to be considered in a limiting sense, because numerous variations are possible. The subject matter of the present disclosure includes all novel and nonobvious combinations and subcombinations of the various processes, systems and configurations, and other features, functions, acts, and/or properties disclosed herein, as well as any and all equivalents thereof.

The invention claimed is:

1. An adjustable display holder comprising:

a display arm substantially in a U-shape, the display arm having pivot posts on an open end of the U-shape and further having two protruding tongues arranged substantially in the direction of each pivot post; and a base with pivot post holes to receive and pivotably connect to the pivot posts of the display arm, the base further having a plurality of grooves, each groove configured to receive a protruding tongue of the display arm, the grooves extending radially outward relative to the pivot post holes for a distance at different angular relationships, wherein the display arm is elastically deformable by a squeezing force imparted on external sides of the display arm to bring the pivot posts on the open end of the U-shape closer together and thereby disengage the tongues from the grooves and permit pivoting of the display arm relative to the base about the pivot posts, and wherein, upon removal of the squeezing force, the display arm is further biased to insert the pivot posts into the pivot post holes and to spring each protruding tongue into a corresponding groove when each tongue and corresponding groove are aligned and thereby hold the display arm in a fixed angular relationship in relative position to the base;

wherein the pivot posts are sized to remain rotatably engaged in the pivot post holes after the tongues are disengaged from the grooves by the squeezing force, to guide rotation of the display arm.

2. The display holder of claim 1, wherein the base further comprises two side rails and two connecting members to connect the side rails, wherein the connecting member closest to the pivot post holes has a stop member protruding substantially parallel to the side rails and at least partially within the space between the pivot post holes, wherein the stop member obstructs the display arm pivot posts from exiting the pivot post holes in the base when the display arm is in a display orientation.

3. The display holder of claim 1, wherein the base further comprises two side rails and two connecting members to connect the side rails, wherein the connecting member closest to the pivot post holes is positioned to prevent the display arm from pivoting past a certain point.

4. The display holder of claim 1, wherein the base further comprises two side rails and two connecting members to connect the side rails, wherein the two side rails have a concave lower edge such that the base has four points of contact that provide a stable support for the display holder.

5. The display holder of claim 1, wherein the base further comprises two side rails and two connecting members to connect the side rails, wherein the two side rails have notched upper edges to hold display objects in place when positioned on the display holder.

6. The display holder of claim 5, wherein the notched upper edges have at least two different geometries to receive different display objects.

7. The display holder of claim 1, wherein the base extends sufficiently beyond the pivot post holes to increase display holder stability.

8. An adjustable display holder comprising:

a flexible display arm formed substantially in a U-shape, the display arm having pivot posts on an open end of the U-shape and further having at least one protruding tongue arranged substantially in the direction of each pivot post; and a molded plastic base with pivot post holes to receive and pivotably connect to the pivot posts of the display arm, the base further having a plurality of grooves, each groove configured to receive the at least one tongue of the display arm, the grooves extending radially outward relative to the pivot post holes for a distance at different angular relationships, wherein the display arm is elastically deformable by a squeezing force imparted on external sides of the display arm to bring the pivot posts on the open end of the U-shape closer together and thereby disengage the tongues from the grooves and permit pivoting of the display arm relative to the base, and wherein, upon removal of the squeezing force, the display arm is further biased to insert the pivot posts into the pivot post holes and to spring each protruding tongue into a corresponding groove when each tongue and corresponding groove are aligned and thereby hold the display arm in a fixed angular relationship in relative position to the base;

wherein the pivot posts are sized to remain rotatably engaged in the pivot post holes after the tongues are disengaged from the grooves by the squeezing force, to guide rotation of the display arm.

9. The display holder of claim 8, wherein the base further comprises two side rails and two connecting members between the side rails, wherein the connecting member closest to the pivot post holes has a stop member protruding substantially parallel to the side rails and at least partially within the space between the pivot post holes, wherein the stop member obstructs the display arm pivot posts from exiting the pivot post holes in the base when the display arm is in a display orientation.

10. The display holder of claim 8, wherein the base further comprises two side rails and two connecting members between the side rails, wherein the connecting member closest to the pivot post holes is positioned to prevent the display arm from pivoting past a certain point.

11. The display holder of claim 8, wherein the base further comprises two side rails and two connecting members between the side rails, wherein the two side rails have a concave lower edge such that the base has four points of contact that provide a stable support for the display holder.

12. The display holder of claim 8, wherein the base further comprises two side rails and two connecting members between the side rails, wherein the two side rails have notched upper edges to hold display objects in place when positioned on the display holder.

13. The display holder of claim 12, wherein the notched upper edges have at least two different geometries to receive different display objects.

14. The display holder of claim 8, wherein the base extends sufficiently beyond the pivot post holes to increase display holder stability.

15. The display holder of claim 1, wherein each tongue is a convex tab and each groove is a slot, each tab and corresponding slot configured to engage when aligned in the absence of an external force applied to either the display arm or the base.

16. The display holder of claim 1, wherein the protruding tongues of the display arm are fixedly and substantially longitudinally aligned with the display arm.

17. An adjustable display holder comprising:

a base including at least one rail having notches to receive an end of a displayed item; and a display arm formed substantially in a U-shape and pivotably connected to the base, a portion of the display arm being configured to support another end of the displayed item;

wherein the base and the display arm are pivotably connected by a pair of pivot posts mounted in a pair of pivot post holes;

wherein an angular orientation of the base relative to the display arm is selectively fixed by positioning at least one tongue in one of a plurality of grooves extending radially outward relative to at least one of the pivot post holes;

wherein the display arm is biased to engage the at least one tongue with one of the plurality of grooves thereby fixing the angular orientation of the base relative to the display arm, and wherein the display arm is further elastically deformable by a squeezing force imparted on external sides of the display arm to bring the external sides of the display arm closer together at an open end of the U-shape and thereby release the tongue from said one of the plurality of grooves for angular adjustment of the display arm and repositioning of the tongue in another one of the plurality of grooves upon release of the squeezing force; and wherein the pivot posts are sized to remain rotatably engaged in the pivot post holes after the at least one tongue is disengaged from said one of the plurality of grooves by the squeezing force, to guide rotation of the display arm.

* * * * *